United States Patent [19]

Koob

[11] Patent Number: 4,722,479

[45] Date of Patent: Feb. 2, 1988

[54] INJECTION HOSE FOR CONSTRUCTION JOINTS IN CONCRETE STRUCTURES

[76] Inventor: Kunibert Koob, Bönninger Strasse 51, D-4234 Alpen, Fed. Rep. of Germany

[21] Appl. No.: 844,012

[22] Filed: Mar. 26, 1986

[30] Foreign Application Priority Data

Apr. 4, 1985 [DE] Fed. Rep. of Germany ..... 3512470

[51] Int. Cl.[4] ..... A01G 25/02

[52] U.S. Cl. ..... 239/145; 239/533.15; 239/570

[58] Field of Search ..... 239/104, 123, 145, 267, 239/268, 288–288.5, 533.1, 533.15, 557, 559, 562, 565, 567, 568, 570, 547; 405/40, 48

[56] References Cited

U.S. PATENT DOCUMENTS

| | | | |
|---|---|---|---|
| 2,798,768 | 7/1957 | Babin | 239/145 |
| 3,157,536 | 11/1964 | Caines | 239/568 |
| 3,946,762 | 3/1976 | Green | 239/145 |
| 4,139,159 | 2/1979 | Inoue et al. | 239/145 |

FOREIGN PATENT DOCUMENTS

| | | | |
|---|---|---|---|
| 1414531 | 11/1975 | United Kingdom | 239/542 |
| 471093 | 8/1975 | U.S.S.R. | 239/542 |

*Primary Examiner*—Andres Kashnikow
*Assistant Examiner*—Michael J. Forman
*Attorney, Agent, or Firm*—Wenderoth, Lind & Ponack

[57] ABSTRACT

An injection hose for construction joints in concrete structures includes an essentially liquid-impermeable base structure of flexible material such as rubber or synthetic material and defining a passage duct. The base structure has along its length radial openings for the escape of injection liquid from the passage duct and, along its length in the area of the radial openings, at least one longitudinal depression for receiving a strip of a material which is compressible under the pressure of the injection liquid and which covers the openings. A hose of liquid-permeable material surrounds the base structure and strip. A plurality of radial openings are provided in the base structure, and the associated depressions and strips are distributed around the circumference of the base structure angularly symmetrically in relation to the central longitudinal axis.

14 Claims, 2 Drawing Figures

INJECTION HOSE FOR CONSTRUCTION JOINTS IN CONCRETE STRUCTURES

BACKGROUND OF THE INVENTION

The invention relates to an injection hose for forming construction joints in concrete structures, and having an essentially liquid-impermeable base structure of flexible material, such as rubber or synthetic material, and defining a passage duct, radial openings along the length of the base structure for the escape of injection liquid, at least one longitudinal depression in the area of the radial openings for receiving a strip of a material which is compressible under the pressure of the injection liquid and which covers the openings, and a hose of liquid-permeable material which sheathes the base structure and the strip.

West German Pat. No. 31 03 041 teaches an injection hose having an inner support body comprising a liquid-permeable wall, a first lattice-like, liquid-permeable hose sheathing this support body and a second lattice-like, liquid-permeable hose sheathing this first hose, in which there is provided between the two lattice-like hoses a hose-shaped nonwoven fabric, which is impermeable to concrete particles from the outside to the inside, but which is permeable to sealants from the inside to the outside. Such injection hoses are expensive to produce and not always reliable during use, because of the need to match the lattice-like hoses and the hose-like nonwoven fabric to the concrete particles and to the sealant used. Moreover, such injection hoses of known construction are frequently difficult to install due to their excessive stiffness and can easily be damaged during harsh treatment at the construction site, which prevents a unfirom distribution of the injection liquid throughout the length of the injection hose.

In order to overcome the above disadvantages, West German Utility Model No. 84 25 518.8 teaches an injection hose of the type described in the introduction, in which the radial opening for the escape of the injection liquid is formed as a slit extending throughout the length of the base structure, and in which the edges of the strip are rounded off and received in appropriate side pits of the depression, and the strip has a spring which engages in the slit. This proposal does eliminate the disadvantages of the injection hose known from West German Pat. No. 31 03 041, but it is subject to further improvements.

SUMMARY OF THE INVENTION that is simpler to produce and to handle than known bases and that ensures that the injection liquid is distributed evenly and reliably to the desired locations.

Accordng to the invention, this object is achieved by distributing a plurality of radial openings in the base structure and the associated depressions and strips around the circumference of the base structure angularly symmetrically (symmetrically in n-radiating fashion; $n \geqq 2$) in relation to the longitudinal axis.

Due to the solution of the invention, an injection hose is provided which is simple to produce and to handle and through which the injection liquid can be delivered without difficulty to any location.

An embodiment of the invention which is particularly preferred from the manufacturing point of view provides for the formation of the radial openings as holes or slits arranged in longitudinal rows, which are distributed at identical angular distances around the circumference of the base structure. In this embodiment, the injection hose consists very advantageously of just one base structure and an appropriate number of strips provided around the circumference, an appropriate number of rows of holes and appropriate strips being provided for different applications. For reasons of symmetry, it is advisable to provide four longitudinal rows of openings with their associated depressions and strips, which are distributed at identical angular distances around the circumference of the base structure.

In another advantageous embodiment of the invention, the depressions and the associated strips have rectilinearly delimited side walls, which in particular (in relation to a given depression) extend at an oblique angle to each other and at acute angles to radii of the base structure. This embodiment, too, is very advantageous from the production engineering viewpoint, because the base structure and the strips can be extruded with ease and the strips are readily insertable into their depressions.

According to another feature of the invention, the width of the base of the depressions is only slighty greater than the diameter of the radial openings in the direction concerned. Advantageously, a diameter of about 3 mm of the openings is provided, while the distance between the openings is about 2 cm, and the diameter of the passage duct about 6 mm. In other embodiments of the invention, the base structure consists of polyvinyl chloride and the sheathing hose is made of a bobbin lace fabric. Advantageously, the strips covering the openings consist of foam rubber, cellular rubber or neoprene, because this makes it easier to choose the necessary compressibility.

BRIEF DESCRIPTON OF THE DRAWINGS

Other objects, features, advantages and application possibilities of the invention will become apparent from the following description of an embodiment thereof, with reference to the accompanying drawings, in which all the features described and/or represented pictorially alone or in any meaningful combination form the subject of the instant invention, and wherein:

FIG. 1 is a cross section of an injection hose according to the invention; and FIG. 2 is a partial perspective vie of the hose of FIG. 1, with one strip and the outer sheath not shown for clarity.

DETAILED DESCRIPTION OF THE INVENTION

Figure 1:
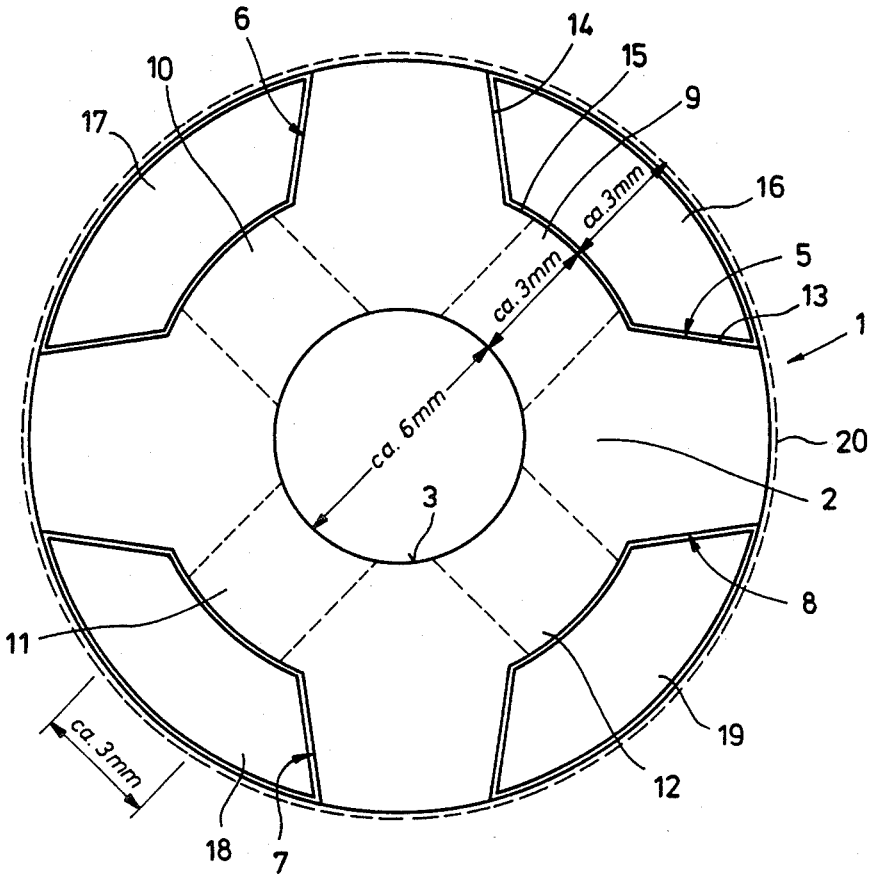
Figure 2:
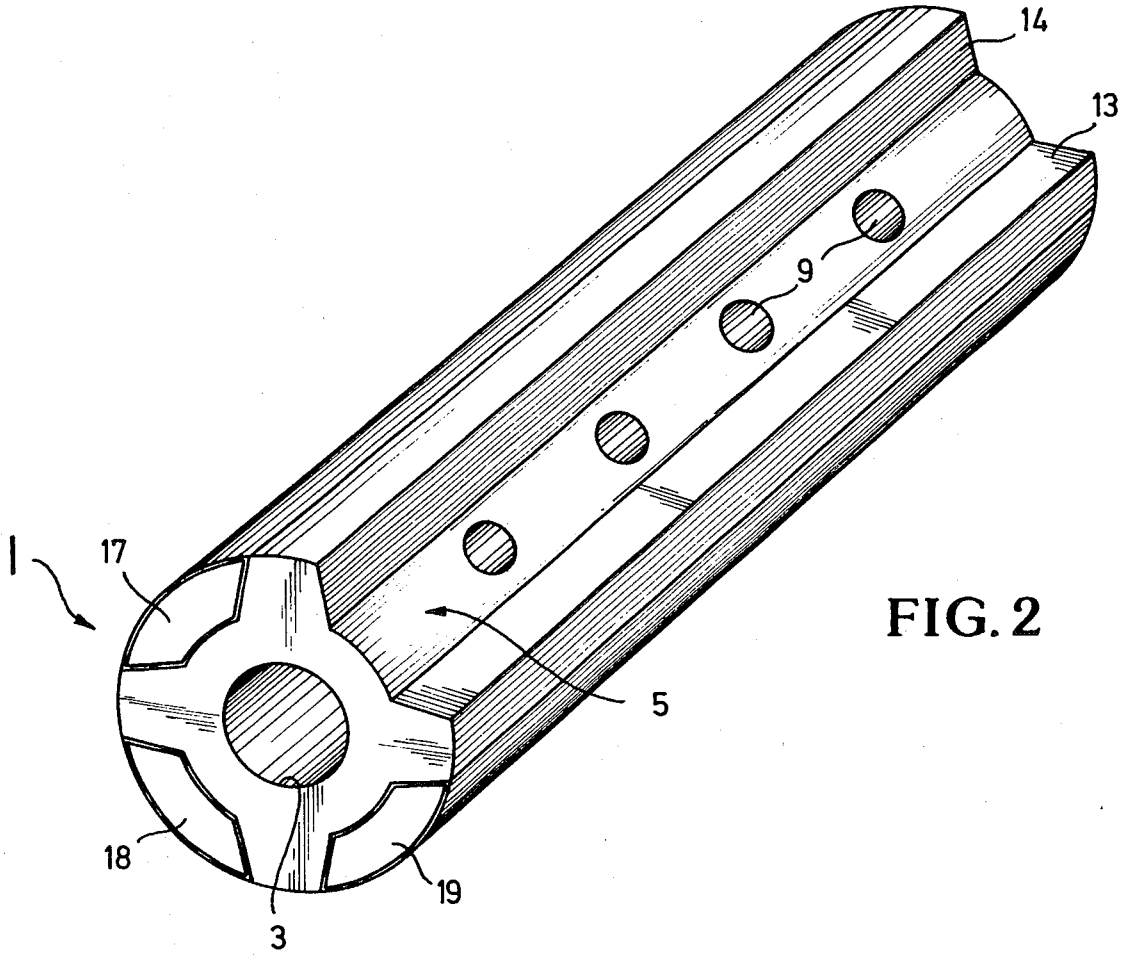

Injection hose 1 includes a base structure 2, which has an essentially hollow cylindrical wall and thus forms a central cylindrical passage duct 3. Injection liquid is supplied through this passage duct 3 at one or at both ends of the injection hose 1 or, as occasion requires, also at connectors therebetween in order to distribute the same along the length of construction joints to be sealed.

Distributed around the circumference of the base structure 2 there are provided at identical angular distances four depressions 5, 6, 7, 8, which extend along the length of the base structure 2. There are provided for fluid coupling of the passage duct 3 and the depressions 5, 6, 7, and 8, radially extending openings 9, 10, 11, 12 which open at first ends thereof into the passage duct 3 and open at second ends thereof into depressions 5, 6, 7, 8. For reasons of symmetry, the depressions 5, 6, 7, 8 are identically constructed, so that only the depression 5 need be described in detail. The depression 5 has two side walls 13, 14 which are arranged to taper obliquely inwardly toward each other, so that at the outer edge of the base structure 2 there is an enlargement. The angle formed by the side walls 13, 14 to radii of base structure 2 is acute. The base 15 of the depression 5 is not substantially wider circumferentially than the diameter of the associated openings 9. The bases 15 of the depressions 5, 6, 7 and 8 are rounded and are disposed on a common imaginary cylindrical surface. Strips 16, 17 18 and 19 are arranged in the depressions 5, 6, 7 and 8, respectively, and have shapes conforming to the shapes of the depressions 5, 6, 7 and 8. Outer surfaces of the strips are flush with the outer circumference of the projections of the base structure 2 which remain between the depressions 5, 6, 7 and 8.

Preferably, the distance between the openings 9, 10, 11 and 12 is about 2 cm and the diameter of the passage duct 3 is preferably about 6 mm, while the diameter of the openings 9, 10, 11 and 12 is about 3 mm. The depth of the depressions 5, 6, 7 and 8 also is preferably 3 mm. Viewed in the axial direction, the openings 9 10, 11 and 12 can be offset in relation to the openings of the adjacent longitudinal row so as to even out the escape of the injection liquid. Polyvinyl chloride is preferred as material for the base structure 2, while the strips 16, 17, 18 and 19 are composed of foam rubber, cellular rubber or neoprene due to the desired compressibility thereof. The base structure 2 and the strips 16, 17, 18 and 19 disposed in the depressions 5, 6, 7 and 8 essentially form a seal with the outer circumference of the base structure 2 and are sheathed by a hose 20 of liquid-permeable material, which, for example, may be a bobbin lace fabric. This securely holds the strips 16, 17, 18 and 19 in their depressions 5, 6, 7 and 8, even if the pressure of the injection liquid is applied from the inside.

In the injection hose 1 of the invention, the penetration of concrete constituents from the outside into the passage duct 3 is avoided with assurance, because upon application of pressure from the outside, the strips 16, 17, 18 and 19 very effectively seal the openings 9, 10, 11 and 12 arranged in longitudinal rows. If, on the other hand, the injection liquid from the passage duct 3 is pressed outwardly against the strips 16, 17, 18 and 19, they are compressed, due to the nature of their material and the joints between the depressions 5, 6, 7 and 8 and the strips 16, 17, 18 and 19 are enlarged such that the injection liquid can emerge evenly from the injection hose 1 along its length and its circumference. During such process, the strips 16, 17, 18 and 19 are held in place by the outer sheathing hose 20, so that, after the passage of the injection liquid, the openings 9, 10, 11 and 12 can be closed effectively again.

The injection hose 1 of the invention is relatively immune to damage due to its thick walls. The sheathing hose 20 can also be subject to fairly serious damage without losing its function as a holder for strips 16, 17, 18 and 19 in the depressions 5, 6, 7 and 8. Expensive support bodies and the like are not necessary for the injection hose 1 of the invention so that, on balance, an injection hose 1 results which is inexpensive to produce and can be handled easily, reliably and safely and is also dependable in operation, especially in the uniform distribution of injection liquid.

I claim:

1. An injection apparatus for use in forming construction joints in concrete structures, said apparatus comprising:

a longitudinally extending base structure formed of a flexible and liquid-impermeable material and having an outer circumference and a central longitudinal axis;

a longitudinal passage extending through said base structure and defining a duct for the supply therethrough of an injection liquid;

a plurality of axial depressions extending inwardly from the outer surface of said base structure, said depressions being equally angularly spaced about said circumference of said base structure;

a plurality of radial openings equally angularly spaced about said circumference of said base structure, said radial openings being aligned axially of said base structure, and said radial openings extending radially through said base structure from said passage and opening into respective said depressions;

a plurality of strips of a compressible and liquid-impermeable material, said strips being positioned within respective said depressions and covering respective said radial openings;

each said strip and the respective said depression having complementary, axially extending opposite side walls tapering obliquely toward each other from radially outwardly to radially inwardly; and a hose of liquid-impermeable material surrounding and enclosing said circumference of said base structure and said strips and retaining said strips within said respective depressions;

whereby, when injection liquid is supplied under pressure through said passage, said injection liquid passes radially outwardly through said openings, compresses said strips outwardly against said hose retaining said strips in said depressions, passes outwardly through spaces between said side walls of said depressions and said side walls of the thus compressed strips, and then passes outwardly through said hose, and whereby penetration of external material into said passage is prevented by external pressure acting radially inwardly on said strips causing said strips to seal said radial openings.

2. An apparatus as claimed in claim 1, wherein said radial openings are arranged in a plurality of axially extending rows, each said row including plural said openings.

3. An apparatus as claimed in claim 2, comprising four said depressions, four said strips, and four said rows of radial openings.

4. An apparatus as claimed in claim 1, wherein each said side wall of said depressions and said strips extend at an acute angle with respect to a radius of said base structure.

5. An apparatus as claimed in claim 1, wherein each said depression has a base surface having a dimension in the circumferential direction of said base structure slightly larger than the dimension in said circumferential direction of the respective said radial openings.

6. An apparatus as claimed in claim 1, wherein said radial openings are spaced axially by a distance of approximately 2 cm.

7. An apparatus as claimed in claim 1, wherein each said radial opening has a diameter of approximately 3 mm.

8. An apparatus as claimed in claim 1, wherein said passage has a diameter of approximately 6 mm.

9. An apparatus as claimed in claim 1, wherein each said depression has a radial depth of approximately 3 mm.

10. An apparatus as claimed in claim 1, wherein said material of said base structure is polyvinyl chloride.

11. An apparatus as claimed in claim 1, wherein said hose is formed of a bobbin lace fabric.

12. An apparatus as claimed in claim 1, wherein said material of said strips is foam rubber.

13. An apparatus as claimed in claim 1, wherein said material of said strips is cellular rubber.

14. An apparatus as claimed in claim 1, wherein said material of said strips is neoprene.

* * * * *